US005167115A

United States Patent [19]

Wernli et al.

[11] Patent Number: 5,167,115

[45] Date of Patent: Dec. 1, 1992

[54] SPINNING MACHINE HAVING MULTI-SECTION ENDLESS CONVEYOR AND METHOD OF MOUNTING THE CONVEYOR

[75] Inventors: Jorg Wernli, Winterthur; Robert Aliesch, Durnten; Hans-Ulrich Vontobel, Ennetbürgen; Junod Andre, Hermatswil; Karl Rimmele, Schmerikon, all of Switzerland

[73] Assignee: Rieter Machine Works, Ltd., Winterthur, Switzerland

[21] Appl. No.: 586,556

[22] Filed: Sep. 21, 1990

[30] Foreign Application Priority Data

Sep. 21, 1989 [EP] European Pat. Off. ..... 89117489.8

[51] Int. Cl.[5] ..... D01H 9/10; D01H 13/00

[52] U.S. Cl. ..... 57/281; 57/90; 57/105

[58] Field of Search ..... 57/281, 274, 266, 276, 57/90, 105; 242/355 A; 198/844.2, 731, 733

[56] References Cited

U.S. PATENT DOCUMENTS

| | | | |
|---|---|---|---|
| 3,429,113 | 2/1969 | Nimtz et al. | 57/281 |
| 3,737,954 | 6/1973 | Tabler | 198/844.2 X |
| 3,760,935 | 9/1973 | Ziegelmeyer | 198/731 |
| 3,905,184 | 9/1975 | Takai et al. | 57/52 |
| 4,458,807 | 7/1984 | Teske | 198/731 |
| 4,813,222 | 3/1989 | Fukuda et al. | 57/281 X |
| 4,964,269 | 10/1990 | Dinkelmann | 57/281 |

FOREIGN PATENT DOCUMENTS

| | | | |
|---|---|---|---|
| 0061432 | 9/1982 | European Pat. Off. . | |
| 0355887 | 2/1990 | European Pat. Off. | 57/266 |
| 3544560 | 7/1986 | Fed. Rep. of Germany . | |
| 3712027 | 10/1987 | Fed. Rep. of Germany . | |
| 57-161134 | 10/1982 | Japan . | |

*Primary Examiner*—Daniel P. Stodola
*Assistant Examiner*—Michael R. Mansen
*Attorney, Agent, or Firm*—Francis C. Hand

[57] ABSTRACT

An endless conveyor in a ring spinning machine comprises bobbin pegs for receiving full and empty bobbins which must assume an exact position in order in a predetermined bobbin change position of the endless conveyor to come into alignment with a spindle or bobbin support arrangement and thus ensure bobbin transfer from or to the bobbin peg. The endless conveyor is divided in the longitudinal direction into various sections which are connected by connecting links or locks of different length in such a manner that a plurality of bobbin pegs arranged on a section in the bobbin change position of the endless conveyor can be exactly aligned with the associated spinning points by inserting locks of different length or by changing the effective length of the locks at both ends.

20 Claims, 4 Drawing Sheets

SPINNING MACHINE HAVING MULTI-SECTION ENDLESS CONVEYOR AND METHOD OF MOUNTING THE CONVEYOR

This invention relates to a spinning machine and, more particularly, to a spinning machine having an endless conveyor.

Various types of spinning machines have been known in which conveyors are used for conveying full and empty bobbins from and to the machine. In some cases, the conveyors have relied upon bobbin pegs for receiving full and empty bobbins. For example, British Patent 1,168,638 describes an endless conveyor constructed as a horizontal conveyor belt with a plurality of bobbin pegs mounted directly on the belt. The endless conveyor is generally constructed as a steel band or belt which distorts as little as possible so that the predetermined intervals of the bobbin pegs, which must coincide exactly with the intervals of the spinning points or stations, remain unchanged even on relatively long operation of the machine. In addition, the bobbin pegs are arranged at half the interval of the spinning stations or points in order to be able to receive during doffing temporarily simultaneously an empty bobbin and a full bobbin (cops) of the associated spinning point.

It is also known from U.S. Pat. No. 3,905,184 to provide bobbin pegs on an endless belt conveyor only at the interval of the spinning points. In this case, an additional peg is provided at each spinning point in order to receive temporarily one of the bobbins to be replaced on a bobbin change.

It is further known from EP-A-0 061 432 to provide an endless conveyor on each machine side of a ring spinning machine or frame with both runs of each endless conveyor being equipped with bobbin pegs so that when changing a full bobbin (cops) for an empty bobbin, the full bobbin can be fitted onto the empty bobbin peg whilst thereafter an empty bobbin is removed from the bobbin peg of the other run associated with the same spinning point and fitted onto the spindle of the spinning point. In this ring spinning machine, the bobbin pegs are connected via angle pieces directly to the endless conveyor.

It is also known from JP-OS 57-161 134 to use the peg trays employed in a spooling frame following a ring spinning machine as an empty bobbin supply means or full bobbin removal means by displacing the peg trays, which generally consist of a circular disc and a center peg arranged perpendicularly thereon, in a guide rail extending around the ring spinning machine. The diameter, in particular the length of a peg tray, is then slightly smaller than the spacing of two adjacent spinning points. The individual peg trays are in contact with each other and are advanced by exerting a force on one or more peg trays, the thrust being at least partially transmitted by the direct contact of the peg trays. A conveying apparatus for such peg trays is also known from DE-OS 3,544,560.

A disadvantage in the ring spinning machine according to JP-OS 57-161 134 is that the bobbin pegs are not exactly in alignment with the spinning points when a group of peg trays with empty bobbins has been pushed on one machine side in front of the associated spinning points. Consequently, before the bobbin change can be performed in the known ring spinning machine, a rake must be pushed at right-angles to the spinning machine longitudinal axis between the peg trays so that the intervals of the adjacent bobbin pegs are exactly coordinated with the intervals of the adjacent spinning stations.

In a similar bobbin transport means described in DE-OS 3,712,027, a reciprocating rail or the like extending along the spinning points is used and cooperates with peg trays displaceable in a guide rail in such a manner that the trays are displaced stepwise up to the associated spinning point. To ensure that the peg trays are exactly aligned with the associated spinning point, the trays must either have a length exactly equal to the spinning point spacing or blocking elements pivotal in pawl-like manner must be provided on the reciprocating rail and disposed exactly at the intervals of the spinning points so that the blocking elements ensure an exact alignment of the peg trays with the associated spinning point even when the holding trays are not in contact with each other. However, the pawls must be mounted with high production expenditure exactly at the correct point of the rail.

Accordingly, it is an object of the invention to provide a simple technique for adjusting the spacing of bobbin receiving elements on an endless conveyor for a spinning machine.

It is another object of the invention to be able to adjust the position of bobbin support pegs on an endless conveyor after mounting of the conveyor on a ring spinning machine.

It is another object of the invention to be able to adjust the positioning of bobbin receiving pegs on a conveyor for a ring spinning machine.

Briefly, the invention provides an endless conveyor for a spinning machine having a plurality of sections which are connected together by a plurality of locks each of which is connected to and between a respective pair of the conveyor sections. In accordance with the invention, each lock is selected from a group of locks of different lengths or the locks may be adjustable in length.

In one embodiment, the locks are of different lengths so that, by interchanging the locks, the position of a conveyor section can be moved in one of two opposite directions while the overall length of the conveyor remains constant.

In another embodiment, each lock is made to be adjustable in length so that the position of a given section of the conveyor can be adjusted by adjustment of the effective lengths of the locks at each end of the section.

In addition, a plurality of means are provided on at least some of the conveyor sections for entraining a plurality of pegs for receiving full and empty bobbins. These means are spaced apart at equal spacing corresponding to a pitch (spacing) of a plurality of spindles on a spinning machine.

In one embodiment, the means on the conveyor sections for entraining a plurality of pegs are in the form of drivers for entraining and pushing peg trays along a support rail extending along at least one side of the spinning machine parallel to a run of the conveyor. In another embodiment, each means on a conveyor section for entraining a plurality of pegs is in the form of a driver for entraining and mounting a peg thereon.

In still another embodiment, each conveyor section may be made of metal with a hook-like bend at each of two opposite ends while each hook has a pair of counter pegs for engaging with a respective bend of an adjacent section. Alternatively, each conveyor section may be made of steel while being rounded at each end with an opening in each end. In this case, each lock has a pair of projections for passage through the respective openings in a pair of adjacent conveyor sections in order to secure the sections together. Alternatively, a plurality of separate securing means may be provided for securing each respective lock to a respective conveyor section. For example, a securing means may be in the form of a threaded screw which passes through an opening in a lock while being threaded into the opening of the conveyor section.

After assembly of the endless conveyor, the individual sections can be adjusted or displaced in the conveying direction to a limited extent relative to the other sections in that the locks at one or both ends are either changed in their length or replaced by locks of somewhat different length.

Furthermore, in advantageous manner, damaged sections of the endless conveyor can be replaced by perfect sections whilst retaining the remaining sections. Moreover, the assembly of the endless conveyor in the spinning mill or partial assembly in the manufacturer's factory is facilitated.

In a ring spinning machine having a predetermined spinning point interval or spacing of for example 70 or 75 mm, only two different belt sections need be kept in readiness. The conveyor belt sections equipped with drivers are able to carry, for example, 24 drivers so that the section with a 70 mm spinning point interval will have a length of 1.68 m and the section with a 75 mm spinning point interval will have a length of 1.80 m.

When arranging 24 drivers on a conveyor belt section of 1.80 m length, a positioning accuracy of ±1 mm is possible. Hence, it is not necessary to adjust each driver individually. Instead, it suffices to adjust a plurality of drivers fixedly mounted on a conveyor belt section jointly by a length adjustability of the conveyor belt section relative to the adjacent conveyor belt sections by means of the locks of variable length or different lengths.

Thus, for spinning machines with spinning point intervals of 70 and 75 mm, a total of only three different conveyor belt sections need be kept in readiness, one with a length of 1.68 m, one with a length of 1.80 m and another with a length such that the driver-free region at the ends of the machine can be bridged.

The invention also provides a method of mounting an endless conveyor in a spinning machine. In this respect, a plurality of drivers are fixedly mounted on each of plurality of elongated conveyor sections at a predetermined pitch. Thereafter, a plurality of locks are secured to the sections in alternating manner in order to form an endless conveyor. This conveyor is then mounted about a spinning machine and moved to position at least one driver-containing section at a bobbin change position. The alignment of the drivers with a plurality of spinning points is then checked in the bobbin change position. Thereafter, the effective length of at least two of the locks at the ends of a respective section are varied in order to position the section therebetween as well as the drivers thereon relative to the spinning points. On the other hand, if the alignment is correct there would be no need to change the locks at the ends of the aligned conveyor section.

These and other objects and advantages of the invention will become more apparent from the following detailed description taken with the accompanying drawings wherein.

Figure 1:
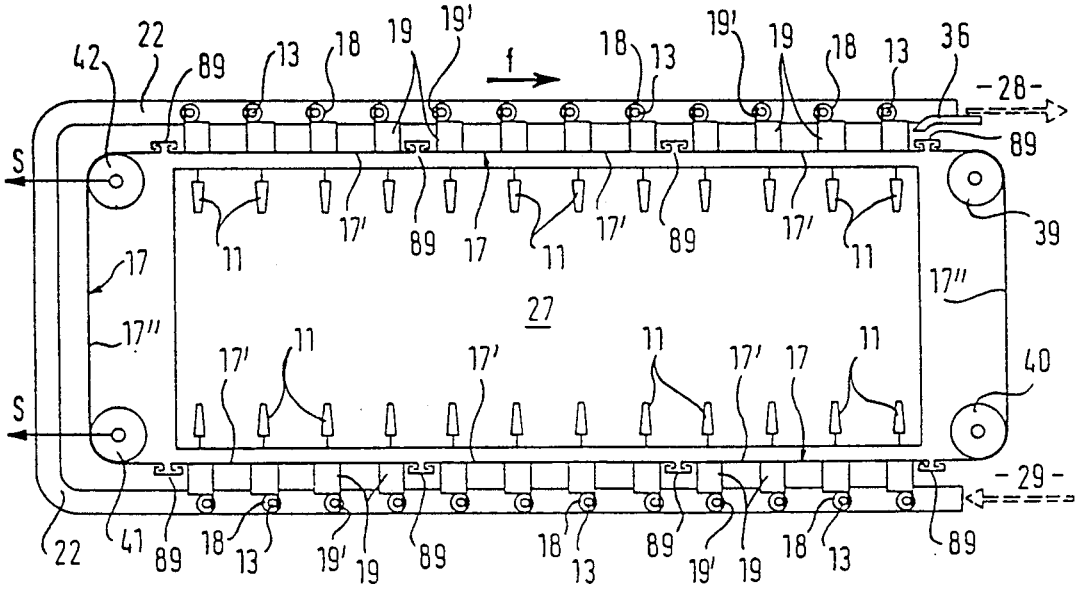
FIG. 1 illustrates a schematic plan view of a ring spinning machine according to the invention having an endless conveyor for empty and full bobbins divided into various sections.

Referring to FIG. 1, an endless conveyor 17 in the form of a vertically disposed steel belt is placed round a ring spinning machine 27 having a plurality of spinning stations 11 disposed at equal intervals on both sides of the machine. As shown, the belt 17 is led around guide rollers 39, 40, 41, 42 at four corners of the machine 27. In the position illustrated, the endless conveyor 17 is in a bobbin change position.

As indicated, the conveyor 17 is moveable in the direction indicated by the arrow f and is composed of a plurality of sections 17', 17'' and a plurality of locks 89 for securing the conveyor sections together. In this respect, the conveyor sections 17' are provided with a plurality of means for entraining a plurality of pegs 13 for receiving full and empty bobbins. The other conveyor sections 17'' are void of any such means and serve to bridge over the ends of the spinning machine 27 when the driver-containing conveyor sections 17' are in the bobbin change position illustrated.

As illustrated, a support rail 22 of U-shape extends along the two longitudinal sides of the spinning machine 27 parallel to the runs of the conveyor 17. In addition, a plurality of peg trays 18 are slidingly mounted on the rail 22 by means of the drivers 19. As indicated in FIG. 2, each peg tray 18 has a peg 13 for receiving a bobbin.

Figure 2:
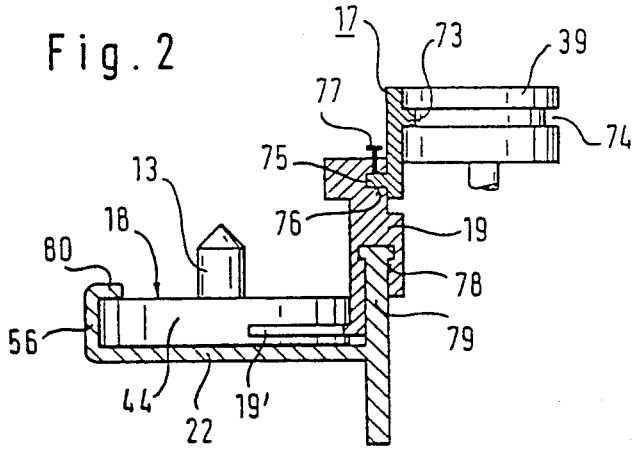
FIG. 2 illustrates a section through the endless conveyor of FIG. 1 perpendicularly to the conveying direction to a greater scale.

As indicated in FIG. 2, each driver 19 engages by means of a finger 19' behind the support peg 13 of a peg tray 18 preferably guided on the support rail 22. The peg trays 18 equipped with empty bobbins are supplied from a buffer section 29 to the support rail 22 and guided by a suitable retaining mechanism (not illustrated) onto the support rail 22 when a driver 19 approaches the guide roller 40.

In the region of the guide roller 39, the end of the support rail 22 led round the machine is disposed where the peg trays 18 are separated by means of a deflector 36 from the driver fingers 19' and the drivers 19 and supplied to a buffer section 28 which may be connected to a spooling frame. Whilst peg trays equipped with empty bobbins are supplied at 29, peg trays 18 equipped with full bobbins (cops) are supplied to the buffer section 28.

In the bobbin change position illustrated in FIG. 1, empty bobbins are removed from the peg trays 18 by a bobbin change means (not illustrated) and deposited on intermediate pegs (not illustrated). The full bobbins (cops) are then removed from the spinning points 11 and placed onto the bobbin pegs 13 of the peg trays 18. Thereafter, the buffered empty bobbins are placed onto the spindles of the spinning points 11 and the spinning operation can then be continued. The full bobbins are now supplied successively to the buffer section 29 by advancing the endless conveyor 17 and are then passed by the buffer section 29 to the spooling frame (not illustrated).

At the same time, via the buffer section 29 from the spooling frame (not illustrated) peg trays equipped with empty bobbins are again supplied to the support rail 22 and the drivers 19 so that, at the latest, after creation of full spools at the spinning points 11, the peg trays 18 again assume the position shown in FIG. 1.

It would also be possible to provide bobbin transfer stations instead of the buffer sections 28, 29.

Figure 3:
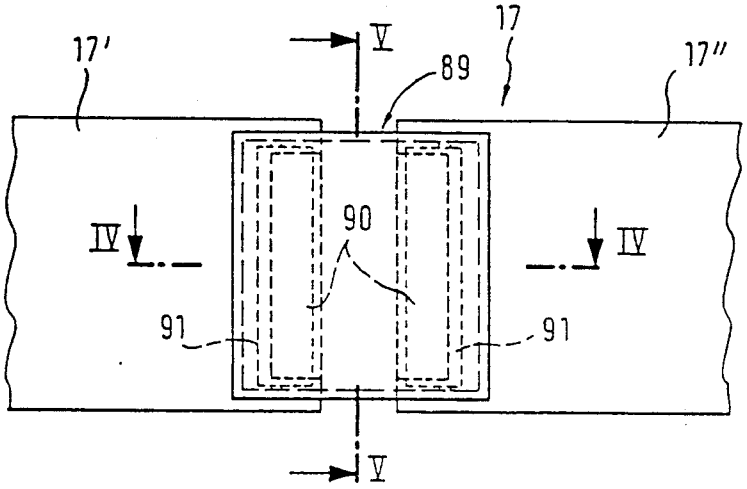
FIG. 3 illustrates a view of an enlarged fragment of the endless conveyor of FIG. 1 seen from the inner side.
Figure 5:
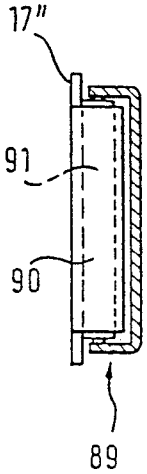
FIG. 5 illustrates a view taken along the line V—V of FIG. 3.
Figure 4:
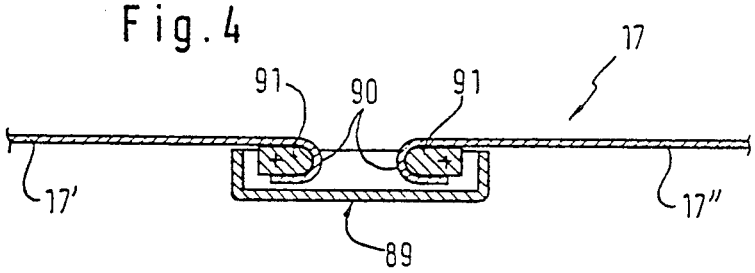
FIG. 4 illustrates a view taken along line IV—IV of FIG. 3.

The endless conveyor 17 is divided where equipped with drivers 19 into sections 17' of equal length which have at their ends hook-shaped bent portions 90 via which they are connected by the locks 89 (FIGS. 3 to 5). In addition, the sections 17'' not equipped with drivers and led at the ends of the machine around the guide rollers 39, 40 and 41, 42 respectively are separate from the remaining sections and likewise connected thereto by hook-like bent portions 90 via locks 89.

In accordance with FIGS. 3 to 5, the locks 89 are formed substantially in the form of a planar plate which extends parallel to the conveyor belt sections 17', 17''. At the top and bottom, the locks or connecting links 89 have angled portions between which at a defined distance in the conveying direction from the hook-like bent portions 90 counter pegs 91 are arranged behind which the hook-like bent portions 90 engage in accordance with FIG. 4.

Both the hook-like bent portions 90 and the connecting link or lock 89 are disposed on the side of the conveyor belt 17 remote from the guide rollers 39, 40, 41, 42. Thus, no projections of the belt surface are present on the side facing the guide rollers. The projections do not, however, represent an obstruction on the outside of the endless conveyor 17. This is where the outwardly projecting drivers 19 are mounted as well.

Fundamentally, the locks 89 could also be provided on the side of the conveyor belt 17 facing the guide rollers. The locks could then not extend over the full width of the conveyor belt 17 and in the peripheral faces of the guide rollers peripheral grooves complementary to the locks would have to be provided.

Whereas the support pegs 13 may also be connected directly to the drivers 19, FIG. 1 shows an embodiment in which the bobbin pegs 13 are mounted on peg trays 18 which are only in entraining and/or guiding engagement with the drivers 19 but alternatively may be entirely carried thereby.

Such an embodiment is shown to a larger scale in section in FIG. 2. As illustrated, the conveyor belt 17 is made of steel and comprises a tongue 73 which projects inwardly from a vertical plane towards the guide roller 39 and engages in a peripheral groove 74 of the guide roller 39. The remaining guide rollers 40, 41, 42 have corresponding peripheral grooves 74. This achieves a perfect vertical alignment between the steel belt 17 and the guide rollers 39–42.

In the lower region, the vertically disposed conveyor belt 17 comprises an outwardly projecting tongue 75 which engages, displaceably in the conveying direction, in a corresponding groove 76 of the dog or driver 19. By schematically indicated clamp means 77, the driver 19 can be fixed in various longitudinal positions relative to the conveyor belt 17. In this manner longitudinal adjustment of the driver 19 relative to the endless conveyor 17 is possible.

In the lower region, the driver 19 comprises a T-shaped guide recess 78 by means of which the driver 19 bears slidingly on a profile 79 complementary thereto and having a T cross-section. The T-profile 79 is fixedly connected to the support rail 22 and a lateral guide 56, i.e. fixed with respect to the machine 27. By means of this, the drivers 19 and the conveyor belt 17 are satisfactorily supported and guided between the guide rollers 39, 40, 41, 42 in the vertical direction as well.

Each peg tray 18 has a cylindrical sliding body 44 slidingly mounted on the support rail 22 which is advanced by the driver finger 19' of the driver 19 when the endless conveyor 17 is set in rotation.

The lateral guides 56 are further bent at their upper end to form a guide edge 80 so that the sliding bodies 44 are secured from above against lifting and can only be moved in the desired conveying direction.

The assembly of the endless conveyor 17 of the spinning machine described above proceeds as follows:

Firstly, for example 24 drivers are mounted immovably on a 1.80 m long steel belt section 17' with an accuracy of ±1 mm. Locks or connecting links 89 of precalculated length are then selected and the number of driver sections 17' necessary for the particular spinning machine 27 are linked together via the locks 89. At the two end sides of the machine, two sections 17'' are attached. In this form, the endless conveyor 17 is assembled.

The two guide rollers 41, 42 can be adjusted in the direction of the arrow S according to FIG. 1 to tension the endless conveyor 17 in desired manner.

As soon as this assembly has been completed, the endless conveyor 17 is brought into the bobbin change position illustrated in FIG. 1 and is checked at which points the bobbin pegs 13 are not yet quite perfectly aligned with the spindles of the associated spinning points 11. The entire respective belt section 17' is then moved in or opposite to the conveying direction f by replacing the locks 89 at both ends by longer or shorter locks. Since a longer connecting link or lock 89 is to be replaced at one end by a shorter lock and a shorter lock 89 by a longer lock at the other end, the peripheral length of the endless conveyor 17 remains the same. Only the relative position of the respective section 17' to the remaining sections is changed in the desired manner by the lock replacement.

Figure 6:
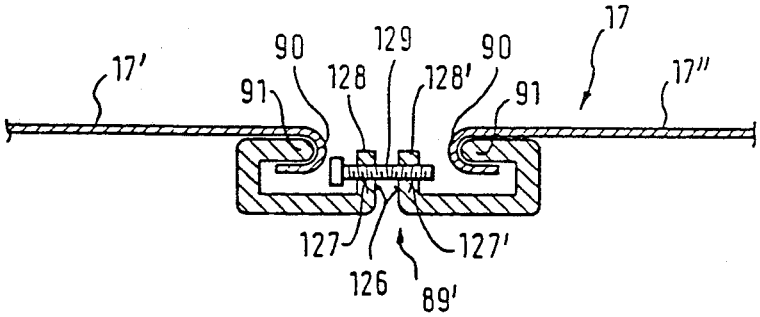
FIG. 6 illustrates a section analogous to FIG. 4 with a lock of variable length.

Referring to FIG. 6, wherein like reference characters indicate like parts as above, the lock 89' may be adjustable to vary the effective length thereof. As shown, the lock 89' is divided in two perpendicularly to the conveying direction. At opposing end edges 126 of the two lock portions, angled portions 128, 128' are provided with threaded bores 127, 127'. The threaded bores 127, 127' are provided with oppositely running threads and into the two bores a through screw 129 with correspondingly oppositely running threads is screwed.

In FIG. 6, the angled portions 128, 128' are shown extending inwardly to the belt sections 17', 17''. However, for easier actuation of the screw 129, the angled portions 128, 128' may however also extend outwardly in the opposite direction where the screw 129 is more easily accessible.

In a predetermined and precalculated position of the screw 129, the locks 89' are inserted between the sections 17, 17' and 17''. Thereafter, relative adjustments of adjacent sections can then be made by turning the screw 129 in the one or other direction. When a lock 89' is shortened at one end of a section 17' or 17'', the lock 89' at the other end is correspondingly lengthened so that the total tension of the endless conveyor 17 remains unchanged and the conveyor belt portion 17' to be adjusted is merely displaced relative to the other sections in the desired manner in or opposite to the conveying direction.

Figure 7:
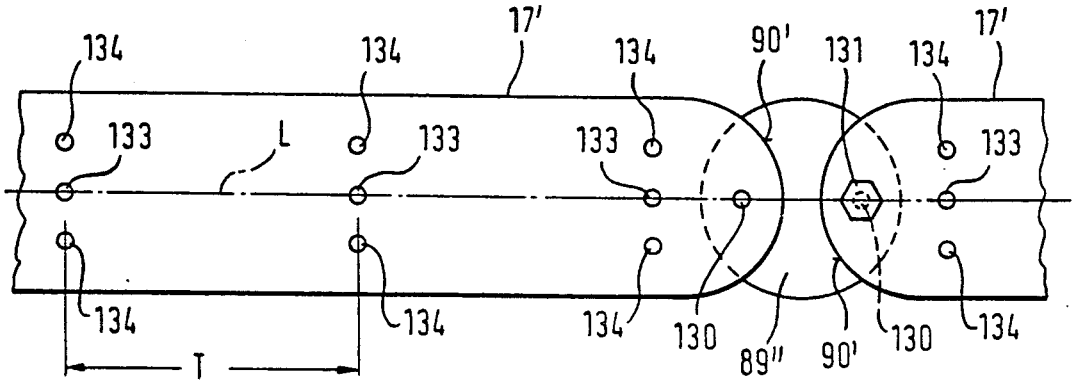
FIG. 7 illustrates a view of an enlarged section of another endless conveyor according to the invention.
Figure 8:
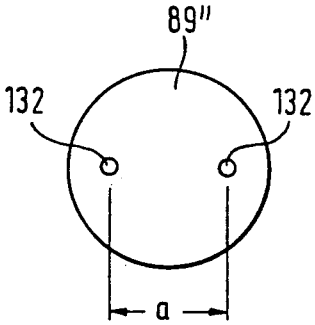
FIG. 8 illustrates a plan view of a lock plate of the endless conveyor of FIG. 7.

FIGS. 7 and 8 show a different layout of the endless conveyor in which the ends 90' of the conveyor belt sections 17' are rounded in the plane of the belt in suitable manner and have mounting openings 130 which are arranged on the central longitudinal axis L of the sections 17'. A lock plate 89'' forming the lock has a suitable rounded shape, for example elliptical or circular, and is provided with two threaded bores 132 the spacing a of which can be of different values, for example 37 mm, 38 mm or 39 mm, so that the spacing between two conveyor belt sections 17, 17' which are to be connected can be varied via the spacing a of the threaded bores 132.

The lock plate 89'' can be connected With one conveyor belt section 17' by passing a securing screw 131 through the opening 130 and screwing the screw 13 into one of the two threaded bores 132.

In place of the described threaded connection any other suitable connection can be provided between the lock plate 89'' and the conveyor belt section 17'. By way of example, hooked spigots which are not shown in more detail could be provided on the lock plate 89'', or the lock plate 89'' can be so formed that to have a threaded bore 132, and a hooked spigot in place of the other threaded bore, so that the lock plate 89'' can be hooked with one of the conveyor belt sections 17' and screwed to the other one.

The conveyor belt sections 17' have driver mounting holes 133 on the central longitudinal axis L at a spacing equal to the pitch T of the spinning positions, which amounts to 70 mm or 75 mm, with two holes 134 providing security against rotation being associated with each of the driver fastening holes. Thus, in each case, three associated holes 133, 134 are provided on a line perpendicular to the central longitudinal axis of the conveyor belt section 17'.

Figure 9:
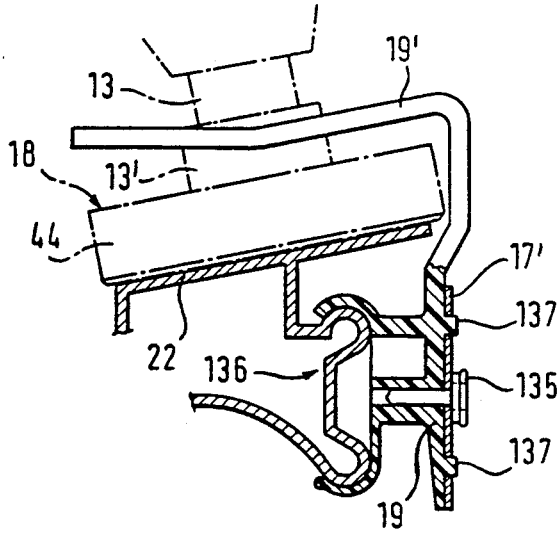
FIG. 9 illustrates a sectional view of a modified conveyor and driver arrangement in accordance with the invention.

As shown in FIG. 9, each driver 19 is screwed to the conveyor belt portion 17' by means of a securing screw 135 which extends through a mounting hole 133 into a corresponding threaded bore on the driver 19. The drivers 19 are arranged on a guide rail 136, which is preferably formed in one piece with a carrier rail 22 for the peg trays 18 and is arranged together with the latter on the machine frame in suitable manner.

Projections 137 are formed on each driver 19 to provide security against rotation and are fitted into the holes 134 in the conveyor belt portion 17' when the driver 19 is screwed to the conveyor belt portion 17'. The driver finger 19', extends, as shown in FIG. 9, over the slide body 44 of the peg tray 18 in order to engage with the carrier peg 13, or, as shown in FIG. 9, with a broadened foot 13', of the carrier peg 13.

Figure 10:
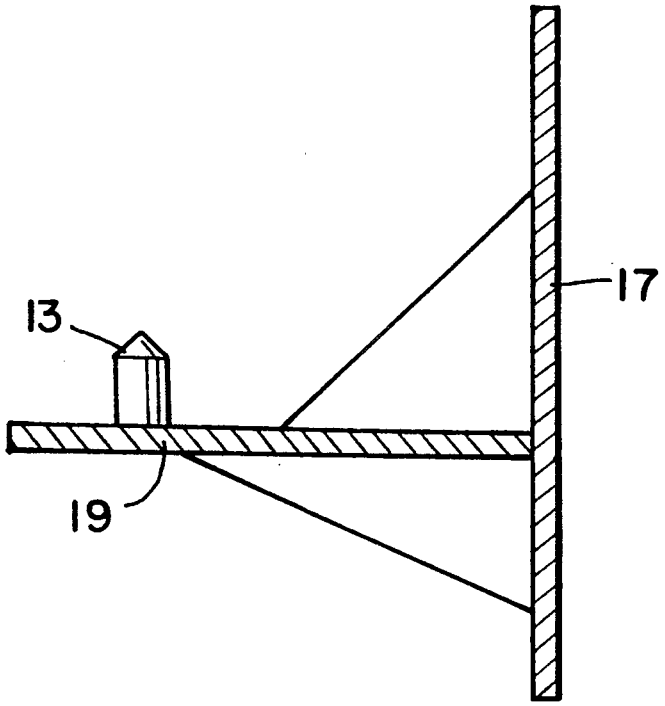
FIG. 10 illustrates a sectional view of conveyor section having a driver for entraining and mounting a peg thereon.

As shown in FIG. 10, wherein like reference characters indicate like parts as above, a conveyor section 17 may also be provided with a driver 19 for entraining and mounting a peg 13 thereon.

What is claimed is:

1. In a spinning machine, the combination comprising an endless conveyor having a plurality of sections and a plurality of locks, each said lock being removably connected to and between a respective pair of said sections to secure said pair of sections together and being selected from a group of locks of different lengths; and a plurality of means on at least some of said sections for entraining a plurality of pegs for receiving full and empty bobbins, said plurality of means of each respective section being spaced apart at equal spacings corresponding to a pitch of a plurality of spindles in said machine.

2. The combination as set forth in claim 1 which further comprises a support rail extending along at least one side of the spinning machine parallel to one run of said conveyor, a plurality of peg trays for sliding on said rail, each tray having a peg thereon for receiving a bobbin.

3. The combination as set forth in claim 2 wherein each means on said conveyor is a driver for entraining and pushing a peg tray along said rail.

4. The combination as set forth in claim 1 wherein each means on said conveyor is a driver for entraining and mounting a peg thereon.

5. The combination as set forth in claim 1 wherein each section is made of steel and has a hook-like bend at each of two opposite ends and each lock has a pair of counter pegs, each counter peg being engaged with a respective bend of an adjacent section.

6. The combination as set forth in claim 1 wherein each section is made of steel and is rounded at each end with an opening in each end.

7. The combination as set forth in claim 6 wherein each lock has a pair of projections for passage through respective openings in a pair of adjacent sections to secure said respective sections together.

8. The combination as set forth in claim 7 wherein each lock is of round shape.

9. The combination as set forth in claim 6 which further comprises a plurality of securing means, each said securing means being passed through a respective lock and secured in a respective opening in a respective section.

10. The combination as set forth in claim 9 wherein each securing means is a threaded screw.

11. The combination as set forth in claim 1 wherein each lock is of a width equal to a width of an adjacent section.

12. The combination as set forth in claim 1 wherein said means on one section are spaced on a pitch of 75 millimeters and said means on a second section are spaced on a pitch of 70 millimeters.

13. The combination as set forth in claim 1 wherein each means is a driver secured to a respective section and having at least one projection received in an opening of a respective section to prevent rotation of said driver.

14. The combination as set forth in claim 13 wherein each driver has a pair of said projections received in openings of a respective section.

15. In a spinning machine, the combination comprising an endless conveyor having a plurality of sections and a plurality of locks, each said lock being removably connected to and between a respective pair of said sections to secure said pair of sections together and being of adjustable length; and a plurality of means on at least some of said sections for entraining a plurality of pegs for receiving full and empty bobbins, said plurality of means of each respective section being spaced apart at equal spacings corresponding to a pitch of a plurality of spindles in said machine.

16. The combination as set forth in claim 15 wherein each lock has a pair of angled portion and a screw threaded into at least one angled portion to adjust a spacing between said angled portions upon turning of said screw, each said angled portion being engaged with an end of a respective section.

17. A method of mounting an endless conveyor in a spinning machine comprising the steps of fixedly mounting a plurality of drivers on each of a plurality of elongated conveyor sections at a predetermined pitch;

securing a plurality of locks to said sections in alternating manner to form an endless conveyor;

mounting the conveyor about a spinning machine and moving the conveyor to position at least one section at a bobbin change position;

checking alignment of the drivers with a plurality of spinning points in said bobbin change position; and thereafter changing the effective length of at least two of said locks to vary the position of a section therebetween and said drivers thereon relative to said spinning points.

18. A method as set forth in claim 17 wherein said two locks are replaced with locks of different effective length.

19. A method as set forth in claim 17 wherein said two locks are longitudinally adjusted to change the effective length thereof.

20. In a spinning machine, the combination comprising an endless conveyor having a plurality of sections and a plurality of locks separate from said sections, each said lock being separately connected to and between a respective pair of said sections to secure said pair of sections together, at least some of said locks being adjustable in length; and a plurality of means on at least some of said sections for entraining a plurality of pegs for receiving full and empty bobbins, said plurality of means of each respective section being spaced apart at equal spacings corresponding to a pitch of a plurality of spindles in said machine.

* * * * *